United States Patent [19]

Schirtzinger

[11] 3,996,756

[45] Dec. 14, 1976

[54] METHOD AND APPARATUS FOR SUPPORTING A DRILLING PLATFORM ON THE OCEAN FLOOR

[75] Inventor: Joseph F. Schirtzinger, Pasadena, Calif.

[73] Assignee: Sea-Log Corporation, Pasadena, Calif.

[22] Filed: Apr. 8, 1974

[21] Appl. No.: 458,986

[52] U.S. Cl. ..... 61/88; 61/50; 166/.5; 175/9

[51] Int. Cl.[2] ..... E02B 17/00; E21B 7/12

[58] Field of Search ..... 61/46.5, 46, 50, 52, 61/53, 74; 166/.5; 175/9

[56] References Cited

UNITED STATES PATENTS

| | | | |
|---|---|---|---|
| 2,382,768 | 8/1945 | Zweers | 61/50 |
| 3,247,672 | 4/1966 | Johnson | 61/46 |
| 3,703,207 | 11/1972 | Horton | 61/46 |
| 3,712,068 | 1/1973 | Liautaud | 61/46.5 |
| 3,763,656 | 10/1973 | Van Daalen et al. | 61/50 |
| 3,768,268 | 10/1973 | Laffont et al. | 61/46.5 |
| 3,769,803 | 11/1973 | Finney | 61/53.74 |

*Primary Examiner*—Jacob Shapiro
*Attorney, Agent, or Firm*—Christie, Parker & Hale

[57] ABSTRACT

A method and apparatus for positioning and supporting a drilling platform on the ocean floor in which the drilling platform is a monopod structure with a broad flat base. The ocean floor is dredged to form a large level area depressed below the mudline. A precast drilling cellar having a flat bottom wall and upstanding side walls extending around the perimeter of the bottom wall is lowered to the leveled area. Hydraulic jets in the bottom of the cellar displace material from beneath the cellar, allowing the cellar to sink into the ocean floor to the depth of the sidewalls. The platform is centered over the cellar with the base resting on the top of the sidewalls.

3 Claims, 10 Drawing Figures

PIPELINE LAID FROM DRILLING SITE TO TERMINAL PIPE

Fig. 4

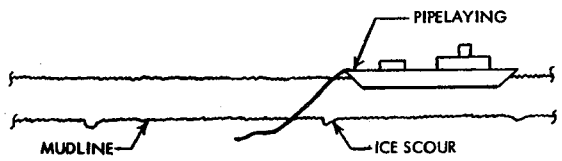

DREDGE REMOVES ROCKS AND LARGE DEBRIS BELOW MUDLINE IN AREA CENTERED ON DRILL SITE; THEN DREDGES AREA BELOW MUDLINE.

Fig. 5

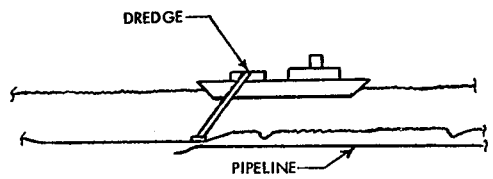

DRILLING CELLAR - WITH TEMPORARY TOP COVER — TOWED TO SITE.

Fig. 6

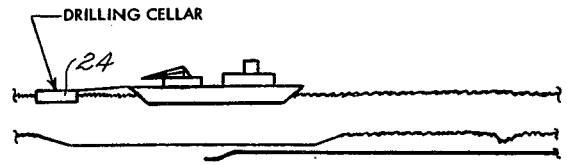

A) CRANE REMOVES TOP COVER FROM CELLAR AND MAKES FAST TO CELLAR.

B) HIGH PRESSURE WATER LINES FOR WATER JETS CONNECTED.

C) WATER PUMPED INTO CELLAR - SUSPENDED FROM CRANE.

D) CELLAR LOWERED INTO BOTTOM AT SITE - NEAR END OF PIPELINE -- USING WATER JETS. LEVEL EMPLACEMENT INSURED BY MESSENGER LINE GAUGES AND DIFFERENTIAL WATER JET CONTROL.

Fig. 7

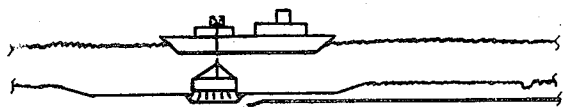

A) CELLAR IN PLACE, WITH TOP AT LEVEL OF DREDGED AREA.

B) MUD INSIDE OF CELLAR REMOVED.

C) DREDGED AREA SMOOTHED OVER IN VICINITY OF CELLAR, TO PRIOR DREDGED LEVEL.

Fig. 8

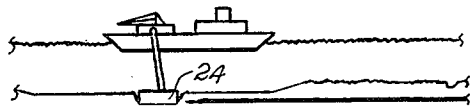

PIPELINE INSTALLED INTO CELLAR AREA.

Fig. 9

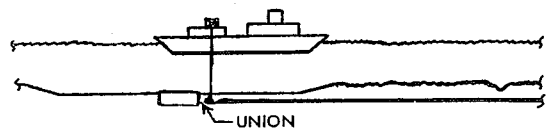

METHOD AND APPARATUS FOR SUPPORTING A DRILLING PLATFORM ON THE OCEAN FLOOR

FIELD OF THE INVENTION

This invention relates to subsea drilling platforms, and more particularly to a method and apparatus for supporting a drilling platform on the ocean floor.

BACKGROUND OF THE INVENTION

With the increased interest in offshort oil production in the icy waters of the arctic, there has developed a need for more mobile drilling platforms which can be readily moved during severe ice conditions but which can operate in the presence of surface ice. A monopod platform with icebreaking capability, such as described in copending application Ser. No. 459,030, filed Apr. 8, 1974, now issued as U.S. Pat. No. 3,871,184 and assigned to the same assignee as the present invention and incorporated herein by reference, has advantages over more conventional drilling platforms for this type of operation. While the monopod type platform can be operated as a semisubmersible, in shallower waters, it is preferable to anchor the platform directly on the ocean bottom. The monopod structure with its flat-bottom lower hull, presents a problem when used for drilling and completing a plurality of development wells at close locations, since room must be provided for mounting the "christmas tree" and other equipment on top of the well after it is drilled and before moving the platform to the next drilling location.

SUMMARY OF THE INVENTION

The present invention is directed to a method and apparatus for preparing a drill site for completion of multiple production wells on the ocean floor. In brief, the present invention utilizes a precast cellar having a flat bottom wall and upstanding sidewalls, the cellar being open at the top. After dredging the ocean floor to provide a level area larger than the bottom of the drilling platform, the cellar structure is lowered by a surface vessel to the center of the leveled area. Fluid jets are provided in the bottom wall of the cellar which are connected to a source of fluid under pressure. The downwardly directed fluid jets remove material from beneath the bottom of the cellar structure, permitting it to bury itself in the ocean floor so as to be depressed below the level of support of the drilling platform on the ocean floor.

BRIEF DESCRIPTION OF THE DRAWINGS

For a more complete understanding of the invention, reference should be made to the accompanying drawings, wherein:

FIGS. 4–9 illustrate the operating sequence in placing the cellar structure at the drill site.

DETAILED DESCRIPTION

Figure 1:
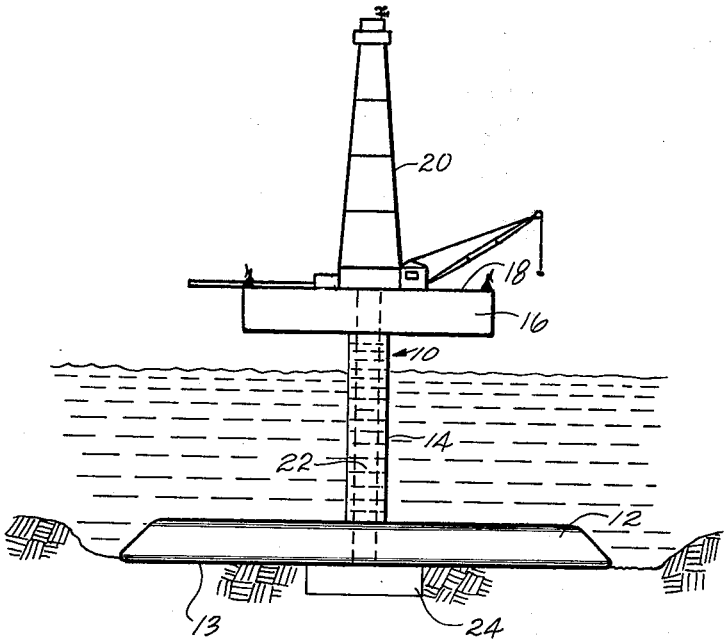
FIG. 1 is a side elevational view of the drilling platform in operative position on the ocean floor.

Referring to FIG. 1, the numeral 10 indicates generally a monopod type drilling platform having a lower submerged hull 12, a vertical supporting column 14, and upper hull 16. The upper hull 16 includes a drilling deck 18 on which is supported a conventional drilling derrick 20. The drilling takes place through an open shaft or moon pool 22 extending from the drilling deck 18 down through the bottom 13 of the lower hull 12. The moon pool provides access to the substrata by the drilling rig. The bottom 13 of the lower hull 12 is designed to rest on the ocean floor after proper site preparation, as hereinafter described, having an emplaced cellar 24.

Figure 3:
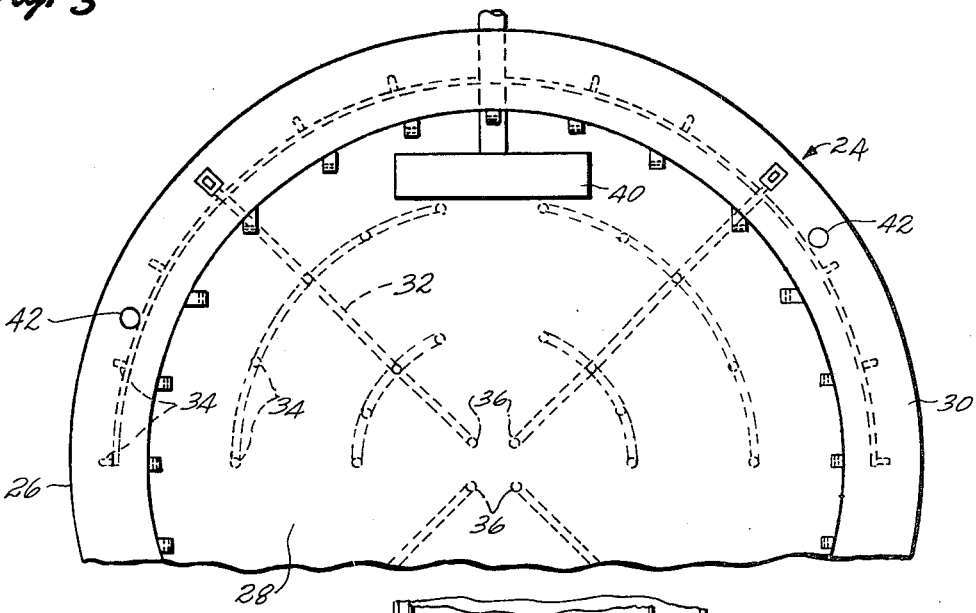
FIG. 3 is a top view of the cellar structure.
Figure 2:
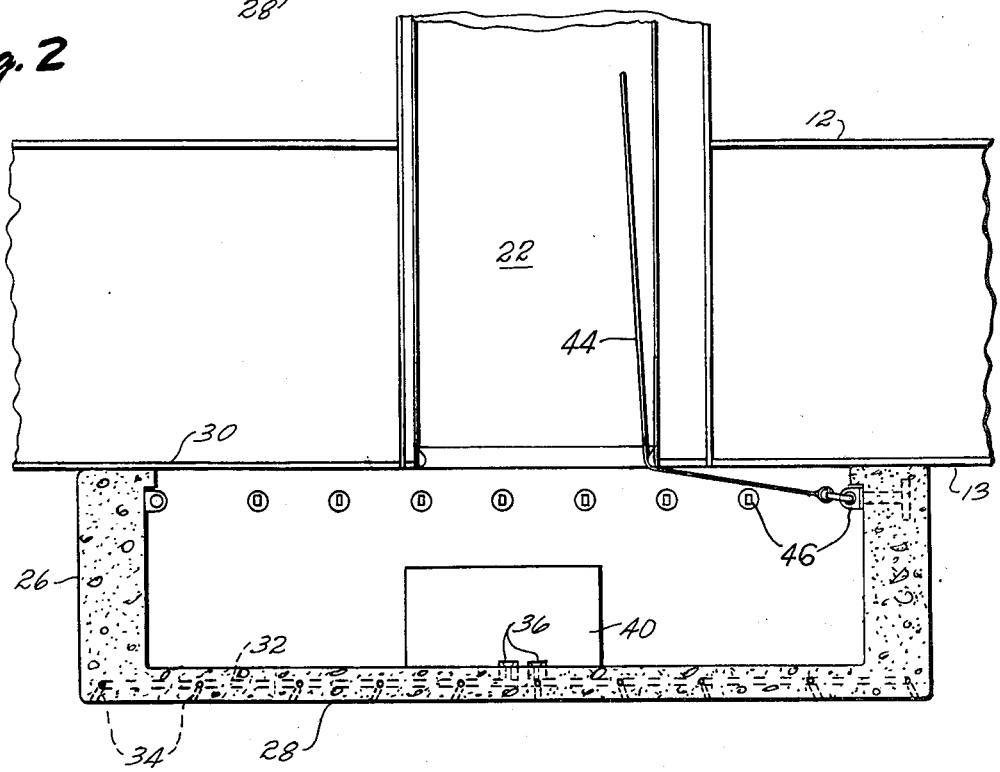
FIG. 2 is a cross-sectional view of the cellar structure.

Referring to FIGS. 2 and 3, the cellar 24 includes a cylindrical sidewall 26 and flat bottom wall 28. The cellar is preferably cast from concrete with relatively thick sidewalls terminating in a flat annular top surface 30. The bottom 13 of the lower hull 12 rests in part on the surface 30, as shown in FIG. 3.

The cellar is cast with a network of high-pressure water lines, indicated generally at 32, in the bottom wall 28 of the cellar. The network of high-pressure water lines supply water under pressure to a plurality of water jets 34 which direct water downwardly beneath the bottom wall 28. As best seen in FIG. 3, the pipe network is preferably arranged in quadrants, with each quadrant having its own input stab connector 36 extending vertically upwardly through the bottom wall 28 on the inside of the cellar 24. Each inlet connector is in turn connected to a series of radiating pipes, each of which in turn is connected to a pattern of jets. By connecting the inlets to a source of water under high pressure, the pattern of high-pressure jets on the bottom of the cellar can be used, as hereinafter described, to control the emplacement of the cellar on the ocean floor.

Referring to FIGS. 4 through 9, the steps required to prepare the drilling site for the monopod drilling platform and to emplace the cellar is shown in detail. As shown in FIG. 4, a surface ship or barge is moved to the drilling site, preferably during the summer when the area is free of ice. Initially a pipeline is laid extending from the drill site to an oil production collection terminal (not shown). The end of the pipeline is submerged below the mudline to a depth corresponding to the desired depth of the emplaced cellar structure. The pipe is submerged in the bottom of the ocean by dredging or otherwise excavating a trench. The balance of the pipeline need not be submerged to the same depth as the end of the pipeline.

Once the pipeline is in place, a dredging operation is performed from the ship 40, as shown in FIG. 5. The dredge removes rocks and large debris to a depth, for example, below any ice scored trenches in the ocean floor. The dredge is then used to level an area substantially greater than the area of the bottom of the drilling platform; for example, an area 300 ft. square is typical.

Once the site is prepared, the drilling cellar 24, with a temporary top cover to keep out water from the inside of the cellar so that it will float, is towed to the drill site.

With the drilling collar positioned over the drill site, the cover is removed from the cellar and high-pressure water lines are connected to the stab connectors 36. The cellar is then flooded to cause it to sink, the cellar being suspended by a cable from a crane on the surface vessel. Water under high pressure is pumped through the water jets beneath the cellar, the jets displacing mud and sand immediately beneath the cellar, permitting the cellar to bury itself below the mud line. Gages for sensing the attitude of the cellar as it is lowered are attached to the cellar with signal lines going to the surface vessel, so that the attitude of the cellar can be continuously monitored. By controlling the water delivered to the respective quadrants of the jet system the emplaced cellar can be maintained level.

As shown in FIG. 8, once the cellar 24 is emplaced, with the top at the level of the dredged area, any mud or debris inside the cellar is pumped out and the dredged area is smoothed out around the outside of the cellar so that the top of the cellar is flushed with the smoothed area on which the bottom of the monopod drilling structure is later rested. A pipeline is then coupled into the production pipe manifold within the cellar, the manifold being indicated at 40 in FIG. 3.

Figure 10:
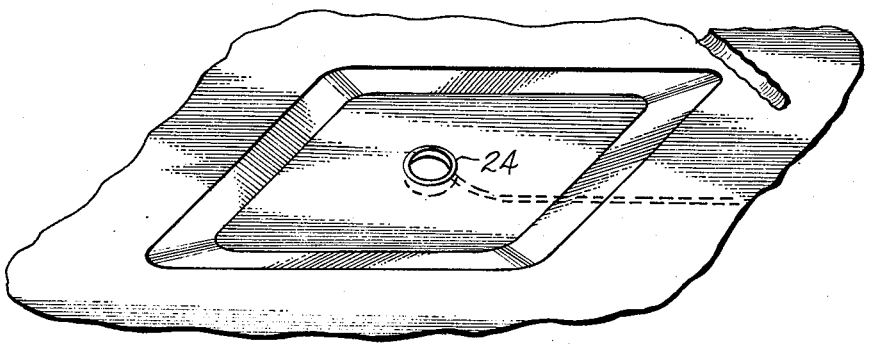
FIG. 10 is a perspective view of the drill site on the ocean floor.

As shown by the perspective view of FIG. 10, the completed drill site provides a depressed area which is sufficiently lower than the bottom of the ice-scored trenches over be relatively free from potential damage by surface ice. The cellar 24 is emplaced in the center of the recessed area and is connected to a pipeline going to a gathering point. The site is now ready for development whenever a monopod drilling structure of the type described in connection with FIG. 1 can be moved on location. The top 30 of the cellar sidewall 26 is preferably provided with transponders, such as indicated at 42, which can be used to locate the cellar from the surface and can be used to guide the monopod drilling structure into position ovr the drill site. After the platform is positioned on the top of the cellar, as shown in FIG. 2, the lateral position of the platform can be adjusted relative to the cellar by means of a cable 44 extending down through the moon pool 22. The end of the cable 44 is attached to any one of a plurality of lugs 46 in the inside wall of the cellar 24. By applying tension to the cable the platform can be shifted in the manner described in detail in the above-identified patent.

What is claimed is:

1. A method of anchoring a production drilling platform having a flat bottom to the ocean floor comprising the steps of:

dredging the ocean floor to form a horizontal depressed area at the drill site;

lowering a preformed drilling cellar having a bottom wall and upwardly projecting side walls to the ocean floor within the depressed area;

pumping fluid in the form of jets from the bottom of the cellar to displace material from beneath the cellar to lower the cellar so that the top of the cellar is flush with the level of the depressed area;

positioning the bottom of the platform on the top of the cellar with the bottom of the platform resting on the surrounding depressed area surface to close off the top of the cellar, adjustably securing the platform to the cellar, and sliding the bottom of the platform horizontally across the top of the cellar to adjust the position of the platform relative to the cellar.

2. Method of claim 1 further comprising the steps of:

laying a pipeline from the drilling site to a collection terminal;

submerging the pipe substantially below the surface of the ocean floor at the drill site;

connecting the end of the submerged pipeline to the interior of the cellar.

3. Method of claim 2 further comprising the steps of:

leveling the surface of the depressed area with the top of the side walls of the cellar; and removing any solid material from the interior of the cellar.

* * * * *